US006513738B1

(12) United States Patent
Braun et al.

(10) Patent No.: US 6,513,738 B1
(45) Date of Patent: Feb. 4, 2003

(54) ADJUSTMENT MECHANISM UTILIZING A VARIABLE DISPLACEMENT MOTOR FOR A ROCK CRUSHER

(75) Inventors: Thomas G. Braun, Muskego, WI (US); John Ponasik, Waukesha, WI (US)

(73) Assignee: Metso Minerals Industries, Inc., Milwaukee, WI (US)

( * ) Notice: Subject to any disclaimer, the term of this patent is extended or adjusted under 35 U.S.C. 154(b) by 0 days.

(21) Appl. No.: 09/506,530

(22) Filed: Feb. 17, 2000

(51) Int. Cl.[7] ..... B02C 25/00
(52) U.S. Cl. ..... 241/30; 241/207; 241/286
(58) Field of Search ..... 241/207–216, 241/286, 287, 288, 289, 290, 30

(56) References Cited

U.S. PATENT DOCUMENTS 3,666,188 A * 5/1972 Lippmann ..... 241/213
4,717,084 A * 1/1988 Vendelin et al. ..... 241/286

OTHER PUBLICATIONS

Nordberg, "HP Series Cone Crusher Instruction Manual–Hydraulic Supplement" .
Nordberg, "Omnicone Crushers", 1993 Nordberg Inc.
Nordberg, "Omnicone Crushers", 1988 Nordberg Inc.

* cited by examiner

*Primary Examiner*—Mark Rosenbaum
(74) *Attorney, Agent, or Firm*—Foley & Lardner

(57) ABSTRACT

A rock crushing system or conical rock crusher includes a bowl which is threadably engaged to a main frame. The bowl can be adjusted with respect to the main frame at more than one speed by utilizing a gap adjustment mechanism including a variable displacement hydraulic motor. Preferably, a set of two variable displacement hydraulic motor units can be utilized to drive the bowl with respect to the frame at a lower torque, higher speed setting and at a higher torque, lower speed setting.

21 Claims, 3 Drawing Sheets

ADJUSTMENT MECHANISM UTILIZING A VARIABLE DISPLACEMENT MOTOR FOR A ROCK CRUSHER

FIELD OF THE INVENTION

The present invention relates generally to rock crushing equipment. More particularly, the present invention relates to a rock crusher capable of adjusting the crushing gap at more than one speed.

BACKGROUND OF THE INVENTION

A rock crushing system generally breaks apart rock, stone or other material in a crushing gap between two elements. For example, a conical rock crusher is comprised of a head assembly including a crushing head which gyrates about a vertical axis within a stationary bowl attached to a main frame of the rock crusher. The crushing head is assembled with an eccentric mechanism that rotates to impart the gyrational motion of the crushing head which crushes rock, stone or other material in a crushing gap between the crushing head and the bowl. The eccentric mechanism can be driven by a variety of power drives such as an attached bevel gear, driven by a pinion and counter shaft assembly, and a number of mechanical power sources, such as electrical motors or combustion engines.

The exterior of the conical crushing head is covered with a protective or wear resistant mantle that engages the material which is being crushed, such as rock, stone, ore, minerals or other substances. The bowl which is mechanically fixed to the main frame is fitted with a bowl liner. The bowl liner and the bowl are stationary and spaced apart from the crushing head. The liner provides an opposing surface from the mantle for crushing the material. The material is crushed in the crushing gap between the mantle and the liner.

The gyrational motion of the crushing head with respect to the bowl crushes rock, stone, or other material within the crushing gap. Generally, the rock, stone or other material is fed into a top of the crushing gap and is crushed as it travels through the crushing gap and exits at a bottom of the crushing gap. The size of the crushing gap determines the maximum size of crushed material which exits the crushing gap.

Generally, the bowl is movably attached to the adjustment ring which is connected to the main frame. The size of the crushing gap can be adjusted by vertically moving the bowl with respect to the crushing head. As the bowl vertically moves with respect to the adjustment ring and main frame, the bowl and bowl liner move vertically with respect to the mantle. A conventional crusher, such as, an HP700™ conical rock crusher manufactured by Metso Minerals of Milwaukee, Wis. includes a bowl threaded to an adjustment ring which is fixed to the main frame by tramp release cylinders. The bowl and connecting adjustment cap is coupled to a gear which surrounds the adjustment cap.

A conventional adjustment mechanism comprised of a hydraulic motor rotates the bowl with respect to the adjustment ring via the gear. The hydraulic motor rotates the bowl with respect to the main frame so that the bowl is vertically raised or lowered, thereby adjusting the gap size.

In another conventional crusher, an MP1000™ conical rock crusher manufactured by Metso Minerals of Milwaukee, Wis. includes an adjustment mechanism having four hydraulic motors. The four hydraulic motors are necessary to move the large bowl associated with the MP1000™ crusher. The four motors rotate the bowl with respect to the main frame to adjust the gap size.

Generally, the bowl must be moved with respect to the head in at least two different situations. First, the bowl is rotated with respect to the head to remove it from the rock crusher for repair and maintenance. Removing the bowl from the annular ring attached to the main frame requires a significant amount of time (e.g., over one hour) as the bowl is threadably disengaged from the annular ring. Alternatively, the bowl can be moved to various gap size heights to allow access and inspection of components of the rock crusher. Maintenance may include operations in which the mantle, crushing head, bowl liner, or bowl are repaired or replaced. Alternatively, other equipment in the crusher can be repaired and replaced or lubricated during maintenance operations. Generally, the bowl is removed when the rock crusher is not operational.

Second, the bowl is moved with respect to the head to adjust the gap size. The gap size is adjusted to alter the size of crushed material exiting the rock crusher. For example, to create crushed material which is smaller, the gap size is decreased. In contrast, to create crushed material which is larger, the gap size is increased. Generally, adjustments of the gap size to create smaller or larger size crushed material require relatively fine positioning of the bowl with respect to the crushing head (e.g., a slow rotation of the bowl with respect to the main frame is necessary).

The gap size can be adjusted while the rock crusher is operating (adjustment under load) or while the rock crusher is non-operational (no load). Adjustments under load require larger amounts of torque than the amount of torque required to adjust the bowl or remove the bowl under no load. Accordingly, conventional gap adjustment mechanisms have required a high torque, slow speed motor.

Certain conventional rock crushers, such as, the MP1000™ rock crusher have utilized two hydraulic pumps to drive the four hydraulic motors. The two hydraulic pumps allow the power unit to drive the four motors at two different speeds. One pump is used for the gap adjustments (e.g., slow speed), both pumps are used for installation and removal of the bowl assembly (e.g., high speeds). However, the use of two hydraulic pumps adds to the cost and size of the power unit.

Thus, there is a need for a low cost, an efficient variable speed gap adjustment mechanism. Further still, there is a need for a variable speed adjustment mechanism which does not require two hydraulic pumps.

SUMMARY OF THE INVENTION

The present invention relates to an apparatus for use with a conical crushing system. The conical crushing system includes a bowl and a frame. The apparatus adjusts a position of the bowl with respect to the head. The apparatus includes a selector and a variable displacement hydraulic motor. The motor is coupled to the selector and operates at a first displacement setting in response to a first position of the selector and at a second displacement setting in response to a second position of the selector. The motor adjusts the position at a first speed when at the first displacement setting and adjusts the position at a second speed when at the second displacement setting.

The present invention further relates to a cone crusher including a frame connected to an adjustment ring having a threaded interface, a bowl threaded to the threaded interface of the adjustment ring, a hydraulic fluid source and an adjustment means. The adjustment means adjusts a position of the bowl with respect to the head in a first direction and a second direction at least a first speed and a second speed according to a first displacement setting and a second displacement setting, respectively.

Further still, the present invention relates to a method of adjusting a position of a bowl with respect to a head in a conical crushing system. The method includes setting a variable displacement hydraulic motor at a first setting to rotate the bowl with respect to the frame at a first speed, and setting the variable displacement hydraulic motor at a second speed to rotate the bowl with respect to the frame at a second speed.

The present invention even further still relates to a cone crusher adjustment mechanism capable to adjusting a position of a threaded bowl with respect to a head in a first direction and a second direction at a plurality of speeds. The cone crusher adjustment mechanism includes at least one variable displacement motor having a shaft. The shaft rotates at a first speed at a first displacement setting and at a second speed at a second displacement setting to adjust the position of the threaded bowl.

The present invention still even further relates to a cone crusher including a frame, a bowl mounted to the frame, a hydraulic fluid source, and an adjustment mechanism. The adjustment mechanism is capable of adjusting a position of the bowl with respect to the head in a first direction and a second direction at at least a first speed and a second speed. The cone crusher adjustment mechanism includes a variable displacement hydraulic motor capable of rotation in response to hydraulic fluid from hydraulic fluid source. The motor drives the bowl at the first speed at the first displacement setting and at the second speed at a second displacement setting.

BRIEF DESCRIPTION OF THE DRAWINGS

Exemplary embodiments will hereinafter be described with reference to the accompanying drawings, wherein like numerals denote like elements and.

DETAILED DESCRIPTION OF THE PREFERRED EXEMPLARY EMBODIMENTS OF THE PRESENT INVENTION

Figure 1:
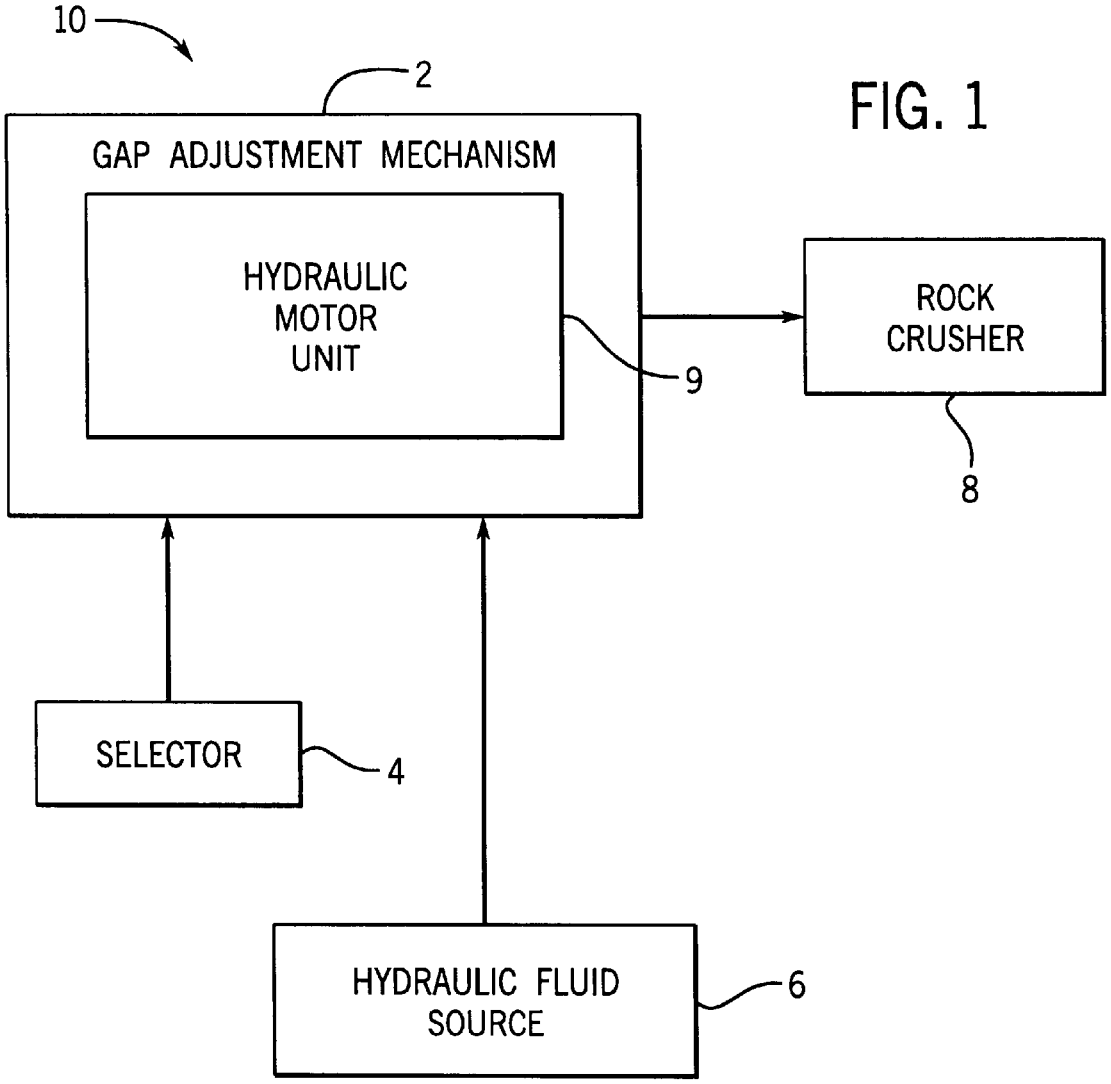
FIG. 1 is a general block diagram of a rock crushing system in accordance with an exemplary embodiment.

Referring to FIG. 1, a conical rock crusher or rock crushing system 10 includes a gap adjustment mechanism 2, a selector 4, a hydraulic fluid source 6, and a rock crusher 8. Gap adjustment mechanism 2 includes a hydraulic motor unit 9. Hydraulic motor unit 9 can include one or more hydraulic motors. Preferably, hydraulic motor unit 9 includes at least one variable displacement hydraulic motor.

Hydraulic fluid source 6 can be any fluid source for providing fluid under pressure. Hydraulic fluid source 6 can be a conventional hydraulic power unit composed of a cabinet with a self contained oil tank, an electric motor, a hydraulic pump, an accumulator, valves, gauges, and other necessary electrical and hydraulic components.

Selector 4 is a valve that selects the toned displacement of the motors and therefore ultimately determines torque and speed at which gap adjustment mechanism 2 adjusts the crushing gap associated with rock crusher 8.

Rock crusher 8 can be any type of rock crusher which utilizes a crushing gap. Preferably, crusher 8 has a crushing gap which is set via a rotational interface, such as, a bowl threadably engaged to a main frame. Rock crusher 8 can be HP™ series rock crusher, such as, the HP700 rock crusher, an MP series rock crusher, a WF series rock crusher, or a Symons™ cone crusher manufactured by Metso Minerals of Milwaukee Wis. Alternatively, rock crusher 8 can be any number of rock crushers manufactured by a variety of sources. Rock crusher 8 is not described in a limiting fashion with respect to the claims of the present application.

Gap adjustment mechanism 2 advantageously can adjust the crushing gap according to at least two speeds. Preferably, mechanism 2 has a higher speed, lower torque mode of operation for removing the bowl associated with rock crusher 8 and a higher torque, lower speed mode for adjusting the gap size associated with rock crusher 8 under load or for making finer adjustments to the crushing gap. The higher speed, lower torque mode is generally utilized in maintenance operations (no load conditions) and the lower speed, higher torque mode is generally utilized under load conditions.

Selector 4 can effectuate the selection of the appropriate speed for adjusting the gap associated with crusher 8 by adjusting the displacement setting associated with hydraulic motor unit 9. A higher displacement setting is utilized for a higher torque, lower speed mode and a lower displacement setting is used for a lower torque, higher speed mode. Additional displacement settings can provide additional torque speed modes.

Figure 2:
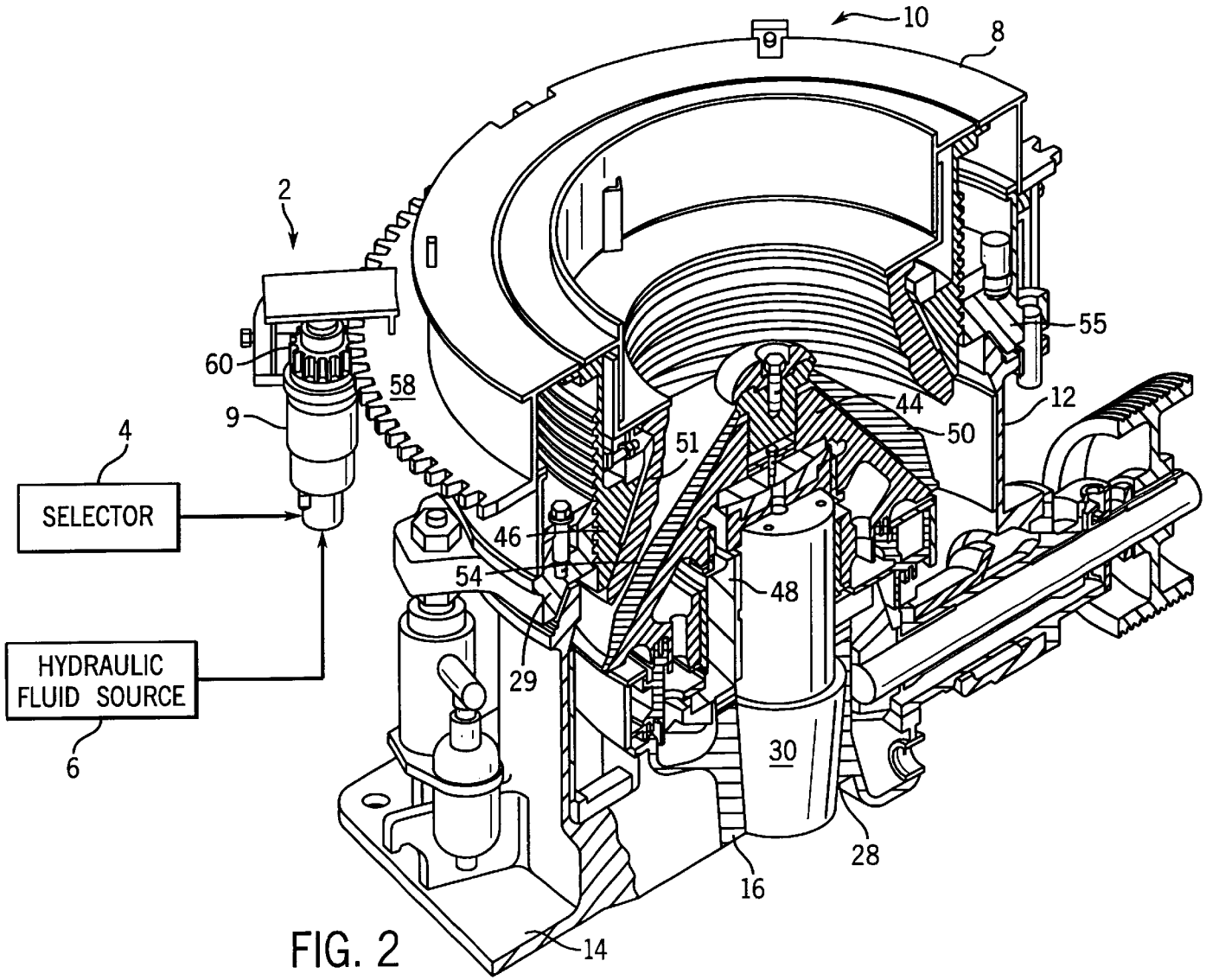
FIG. 2 is a perspective view, in partial cutaway, of the rock crushing system illustrated in FIG. 1.

Referring to FIG. 2, rock crusher 8 is embodied as a HP700 rock crusher. Rock crusher 8 includes a structure or main frame 12 having a base 14. Crusher 8 can be any size rock crusher or any size of crusher head, such as a short head or a standard head. Base 14 rests upon a platform-like foundation which can include concrete piers (not shown), a foundation block, a platform, or other supporting members.

Central hub 16 of main frame 12 includes an upwardly diverging vertical bore or tapered bore 28. Bore 28 is adapted to receive a main shaft 30. Shaft 30 is preferably held stationary in bore 28 with respect to central hub 16 of frame 12.

Shaft 30 supports an eccentric mechanism 48 which is coupled to a head assembly 44. Eccentric mechanism 48 rotates about shaft 30, thereby causing head assembly 44 to gyrate within rock crushing system 10. The gyration of head assembly 44 within a bowl 46 which is fixed to adjustment ring 55 connected to main frame 12 allows rock, stone, ore, minerals, or other materials to be crushed between a mantle 50 and a bowl liner 51. Materials are crushed in a crushing gap 54. Bowl liner 51 is held against bowl 46, and mantle 50 is attached to head assembly 44. Head assembly 44 forces mantle 50 towards bowl liner 51 to effect the rock crushing operation.

Bowl 46 is threadably engaged to an adjustment ring 55 fixed to main frame 12. Bowl 46 is coupled to a gear 58 which is in communication with a gear 60 associated with hydraulic motor unit 9. System 10 preferably includes a second hydraulic motor unit 9 located ⅓ the arc distance along gear 58. A third hydraulic motor unit or a idler assy can be utilized at ⅔ the arc distance along gear 58 to balance the loading along gear 58. Alternatively, system 10 can include any number of motor units 9. In another alternative embodiment, a single motor unit 9 can drive multiple gears 60.

The adjustment of the size of gap 54 is accomplished by rotating gear 60 via motor unit 9. Rotation of gear 60 rotates gear 58 which in turn rotates bowl 46 with respect to adjustment ring 55. In this embodiment, a counter-clockwise rotation of bowl 46 increases the size of gap 54, and a clockwise rotation of bowl 46 decreases the size of gap 54. Alternatively, ring 55 and bowl 46 may be configured such that a counter clockwise rotation of bowl 46 decreases the size of gap 54 and accordingly a clockwise rotation of bowl 46 increases the size of gap 54. Further, other interferences, threadable or otherwise adjustable, can be utilized to position bowl 46 with respect to assembly 44.

System 10 can advantageously rotate bowl 46 at more than one speed by utilizing a variable displacement hydraulic motor in unit 9. Selector 4 allows the speed to be chosen by adjusting the displacement setting for the variable displacement hydraulic motor. Preferably, unit 9, motors 122 and 124 (FIG. 3) can be set to a higher speed setting or a lower speed setting. Accordingly, motor unit 9 effectuates rotation of gear 60 and hence, the adjustment of gap 54 at two different speeds.

Figure 3:
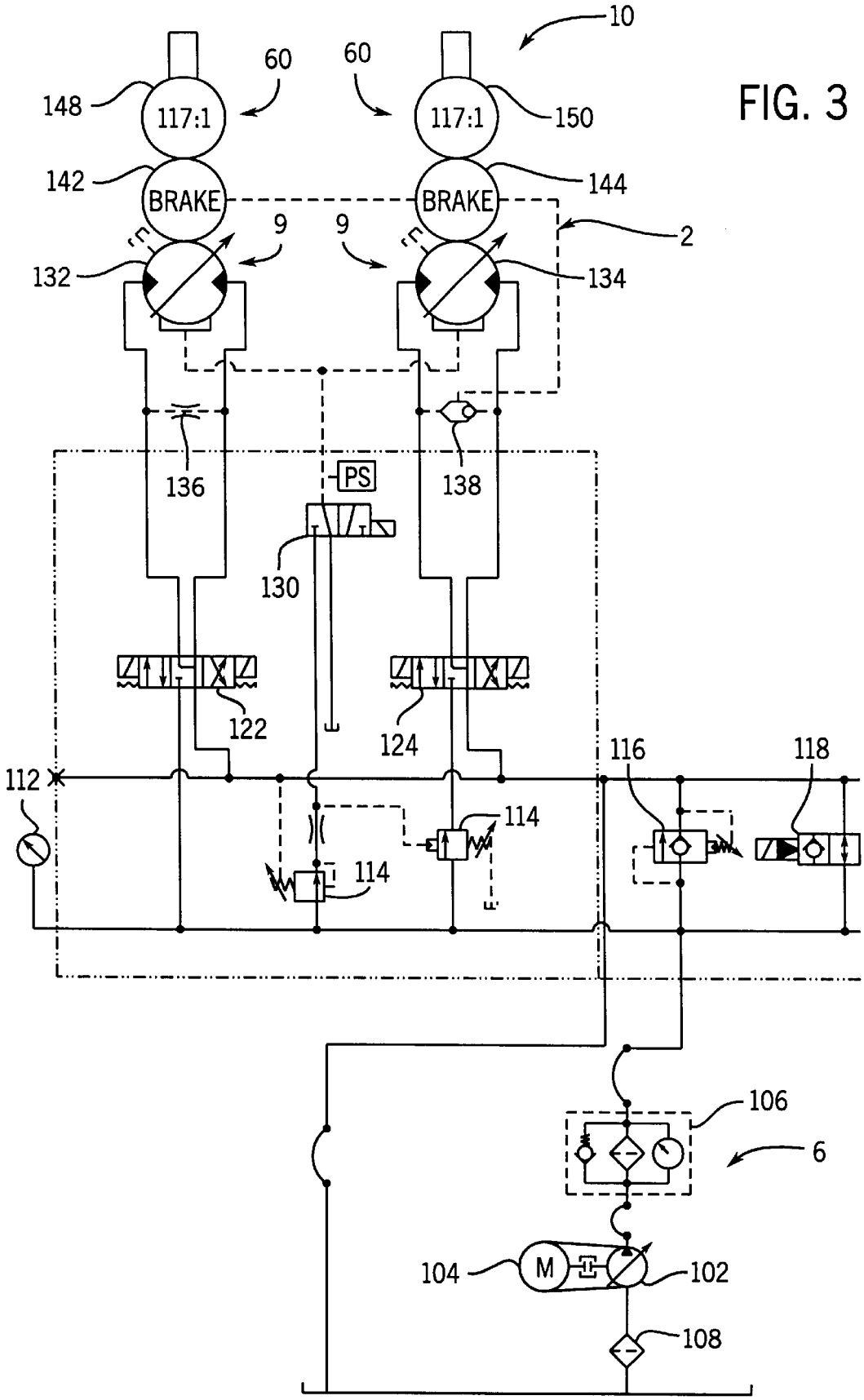
FIG. 3 is a detailed hydraulic schematic diagram of the rock crushing system illustrated in FIG. 1.

With reference to FIG. 3, the operation of gap adjustment mechanism 2 for conical crushing system 10 is described in more detail with respect to the hydraulic components. Hydraulic fluid source 6 includes a pump 102 driven by an electric motor 104. Pump 102 provides high pressure hydraulic fluid through high pressure in-line filter 106. Pump 102 draws hydraulic fluid through a magnetic suction separator 108 which can be a donut shaped ceramic magnet.

Gap adjustment mechanism 2 includes an overspeed protection apparatus 114, a gauge 112, a main relief valve 116, and an open loop valve 118. Open loop valve 118 is a neutral solenoid valve which removes pressure from mechanism 2 when power is lost. Mechanism 2 also includes directional control valves 122 and 124 for controlling the direction of rotation of high variable speed hydraulic motors 132 and 134. Valves 122 and 124 are preferably controlled by a solenoid and provide hydraulic fluid in a first direction to motors 132 and 134 when in a first position and provide hydraulic fluid in a second direction when in a second position. Motors 132 and 134 rotate in a direction corresponding to the direction of hydraulic fluid flowing through motors 132 and 134.

System 2 also includes a cross bleed orifice 136 and release shuttle 138. Shuttle 138 disengages brakes 142 and 144 on motors 132 and 134 when fluid is provided to motors 132 and 134. Cross bleed orifice 132 allows for error in the flow when variable displacement motor 132 is set to zero displacement as described below.

Motors 132 and 134 are variable displacement parallel feed motors. Alternatively, motors 132 and 134 can be piston motors or other hydraulic motors capable of variable displacement and zero stroke.

Motor 132 can be set to a zero displacement setting or a 2.8 cubic inches per revolution displacement setting. Motor 134 can be set to a displacement setting of 2.3 cubic inches per revolution and a displacement setting of 2.8 cubic inches per revolution.

The settings for motors 132 and 134 is controlled by a logic selector valve 130. Preferably, logic selector valve 130 is a solenoid valve which allows a user to select a high or low speed for mechanism 2. Valve 130 is preferably electrically coupled to a user interface (selector 4, FIG. 1) which allows the user to select a first displacement setting where motor 132 has a displacement of zero cubic inches per revolution and motor 134 has a displacement setting of 2.3 cubic inches per revolution or a second displacement setting where motor 132 has a displacement setting of 2.8 cubic inches per revolution and motor 134 has a displacement setting of 2.8 cubic inches per revolution.

When fluid is provided to motors 132 and 134, brakes 142 and 144 are disengaged via shuttle 138 and can rotate. When fluid is provided to one or both of motors 132 and 134, shafts 148 and 150, associated with gear 60 (FIG. 2) are rotated in the direction controlled by valves 122 and 124.

In operation, gap adjustment mechanism 2 is set to a higher speed, lower torque setting by setting motor 132 to the zero displacement setting and setting motor 134 to the 2.3 cubic inch per revolution setting. In this mode, mechanism 2 rotates at a lower torque, and higher speed. Motor 134 provides the force for rotating shaft 150 while motor 132 follows the action of motor 134 because it is at the zero cubic inches per revolution displacement setting. This higher speed mode can be utilized to remove bowl 46 from adjustment ring 55 for maintenance operations. Preferably, the settings provided can allow the bowl to be removed in fifteen minutes or less for a HP700 rock crusher.

A user can make finer adjustments under load or under no load conditions via logic selector 130. Logic selector 130 can set motor 132 to a displacement setting of 2.8 cubic inches per revolution and motor 134 to a displacement setting of 2.8 cubic inches per revolution. At these settings, motors 132 and 134 provide a higher torque, lower speed mode of operation. This mode can be utilized to provide finer adjustments to the position of the bowl with respect to the frame. In this way, mechanism 2 advantageously can turn bowl 46 at a slower speed for adjusting under load and a faster speed for bowl installation and removal. Preferably, motors 132 and 134 utilize a triple reduction gear reducer.

Mechanism 2 can utilize a single motor with two displacement settings. However, system 2 shown in FIG. 3 advantageously uses two motors so greater torque is available and a smaller sized hydraulic fluid source 6 can be utilized.

It is understood that the above description is of preferred exemplary embodiment of the present invention. The present invention is not limited to the specific form shown. For example, although a dual motor system is shown, a single motor or more than two can be utilized. Also, the specific displacement settings given are merely examples. These and other modifications may be made in the design and arrangement of the elements discussed here without departing from the scope of the invention as expressed in the appended claims.

What is claimed is:

1. An adjustment apparatus for a conical crushing system having a frame, adjustment ring, bowl and a head, the apparatus adjusting a position of the bowl with respect to the head, the apparatus comprising:

a selector; and a variable displacement hydraulic motor coupled to the selector, the variable displacement hydraulic motor operating at a first displacement setting in response to a first position of the selector and at a second displacement setting in response to a second position of the selector, the motor adjusting the position at a first speed when at the first displacement setting and adjusting the position at a second speed when at the second displacement setting.

2. The apparatus of claim 1, wherein the motor is a piston motor.

3. The apparatus of claim 1, wherein the first speed is a higher torque, lower speed operation and the second speed is a higher speed, lower torque operation.

4. The apparatus of claim 1, further comprising:

a second variable displacement hydraulic motor wherein the displacement for the first motor and second motor is at the first displacement setting for the first speed and the displacement for the second motor is at a third displacement setting and the displacement for the first motor is at the second displacement setting for the second speed.

5. The apparatus of claim 4, wherein the first displacement setting is larger than the second displacement setting and the third displacement setting is approximately zero.

6. A cone crusher, comprising:

a frame having a threaded interface;

a bowl threaded to the threaded interface of the frame;

a hydraulic fluid source; and an adjustment means for adjusting a position of the bowl with respect to the frame in a first direction and a second direction, the adjustment means having at least a first speed and a second speed corresponding to a first displacement setting and a second displacement setting of the adjustment means, respectively.

7. The cone crusher of claim 6, wherein the adjustment means includes a plurality of variable displacement hydraulic motors.

8. The cone crusher of claim 7, wherein the displacement for a first motor and a second motor is at a first displacement setting for the first speed and the displacement for the second motor is at a third displacement setting and the displacement for the first motor is at a second displacement setting for the second speed.

9. The cone crusher of claim 8, wherein the first and second motors are piston motors.

10. A method of adjusting a position of a bowl with respect to a frame in a conical crushing system, the method comprising:

setting a variable displacement hydraulic motor at a first setting to rotate the bowl with respect to the frame at a first speed; and setting the variable displacement hydraulic motor at a second setting to rotate the bowl with respect to the frame at a second speed.

11. The method of claim 10, wherein the second speed is utilized to remove the bowl from the frame and the first speed is used during crushing operations.

12. The method of claim 11, wherein the first speed is a higher torque, lower speed operation and the second speed is a higher speed, lower torque operation.

13. A cone crusher adjustment mechanism capable of adjusting a position of a threaded bowl with respect to a frame in a first direction and a second direction at a plurality of speeds, the cone crusher adjustment mechanism comprising at least one variable displacement hydraulic motor having a shaft, the shaft rotating at a first speed at a first displacement setting and at a second speed at a second displacement setting to adjust the position of the threaded bowl.

14. The cone crusher adjustment mechanism capable of adjusting a position of a threaded bowl with respect to a frame in a first direction and a second direction at a plurality of speeds of claim 13, wherein the first speed is a higher torque, lower speed operation and the second speed is a higher speed, lower torque operation.

15. The cone crusher adjustment mechanism capable of adjusting a position of a threaded bowl with respect to a frame in a first direction and a second direction at a plurality of speeds of claim 14, further comprising a second variable displacement hydraulic motor wherein the displacement for the first motor and second motor is at the first displacement setting for the first speed and the displacement for the second motor is at a third displacement setting and the displacement for the first motor is at the second displacement setting for the second speed.

16. The cone crusher adjustment mechanism capable of adjusting a position of a threaded bowl with respect to a frame at a plurality of speeds in a first direction and a second direction of claim 15, wherein the first setting is larger than the second setting and the third setting is approximately zero.

17. The cone crusher adjustment mechanism capable of adjusting a position of a threaded bowl with respect to a frame in a first direction and a second direction at a plurality of speeds of claim 13, further comprising a selector switch for selecting one of the plurality of speeds by hydraulically setting the first displacement setting and the second displacement setting.

18. A cone crusher comprising:

a frame;

a bowl mounted to the frame;

a hydraulic fluid source; and an adjustment mechanism capable of adjusting a position of the bowl with respect to the frame in a first direction and a second direction, the adjustment mechanism having at least a first speed and a second speed, the cone crusher adjustment mechanism including a variable displacement hydraulic motor capable of rotation in response to hydraulic fluid from the hydraulic fluid source, whereby the motor drives the bowl at the first speed at a first displacement setting and at the second speed at a second displacement setting.

19. The cone crusher of claim 18 further comprising:

a second variable displacement hydraulic motor wherein the displacement for the first motor and second motor is at the first displacement setting for the first speed and the displacement for the second motor is at a third displacement setting and the displacement for the first motor is at the second displacement setting for the second speed.

20. The cone crusher of claim 19, wherein the first and second motors are piston motors.

21. The cone crusher of claim 18, wherein the first speed is a higher torque, lower speed operation and the second speed is a higher speed, lower torque operation.

* * * * *